US009707754B2

(12) United States Patent
Rivas

(10) Patent No.: US 9,707,754 B2
(45) **Date of Patent: *Jul. 18, 2017**

(54) FLUID EJECTION DEVICE WITH PARTICLE TOLERANT LAYER EXTENSION

(71) Applicant: HEWLETT-PACKARD DEVELOPMENT COMPANY, L.P., Houson, TX (US)

(72) Inventor: Rio Rivas, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 15 days.

This patent is subject to a terminal disclaimer.

(21) Appl. No.: 14/650,833

(22) PCT Filed: Dec. 20, 2012

(86) PCT No.: PCT/US2012/070794

§ 371 (c)(1),
(2) Date: Jun. 9, 2015

(87) PCT Pub. No.: WO2014/098855

PCT Pub. Date: Jun. 26, 2014

(65) Prior Publication Data

US 2015/0314601 A1 Nov. 5, 2015

(51) Int. Cl.
*B41J 2/165* (2006.01)
*B41J 2/05* (2006.01)
(Continued)

(52) U.S. Cl.
CPC ..... *B41J 2/14201* (2013.01); *B41J 2/1404* (2013.01); *B41J 2/14145* (2013.01); *B41J 2/1606* (2013.01); *B41J 2002/14306* (2013.01)

(58) Field of Classification Search
CPC ..... B41J 2/1404; B41J 2/14145; B41J 2002/14387; B41J 2/14201; B41J 2/1606
(Continued)

(56) References Cited

U.S. PATENT DOCUMENTS 6,364,466 B1 4/2002 Chen et al.
6,575,560 B2 6/2003 Kaneko et al.
(Continued)

FOREIGN PATENT DOCUMENTS

CN 1839046 9/2006
CN 1891465 1/2007
(Continued)

OTHER PUBLICATIONS

Lee, J-D et al; A Thermal Inkjet Printhead with a Monolithically Fabricated Nozzle Plate & Self-aligned Ink Feed Hole; Jrnl of MEM. Sys; vol. 8/No. 3; Sep. 2, 1999; pp. 229-236.

*Primary Examiner* — An Do
(74) *Attorney, Agent, or Firm* — HP Inc.—Patent Department

(57) ABSTRACT

In an embodiment, a fluid ejection device includes a thin-film layer formed over a substrate. A primer layer is formed over the thin-film layer, and a chamber layer is formed over the primer layer that defines a fluidic channel leading to a firing chamber. The fluid ejection device includes a slot that extends through the substrate and into the chamber layer through an ink feed hole in the thin-film layer. The fluid ejection device also includes a particle tolerant extension of the primer layer that protrudes into the slot. In some implementations, the particle tolerant primer layer extension extends across a full width of the slot.

19 Claims, 11 Drawing Sheets

(51) Int. Cl.
*B41J 2/14* (2006.01)
*B41J 2/16* (2006.01)

(58) Field of Classification Search
USPC ..... 347/22, 40, 45, 47, 54, 56, 63–65, 68
See application file for complete search history.

(56) References Cited

U.S. PATENT DOCUMENTS

| | | | | |
|---|---|---|---|---|
| 6,764,605 | B2 | 7/2004 | Donaldson et al. | |
| 7,282,448 | B2 * | 10/2007 | Chen | B41J 2/14145 257/223 |
| 7,665,825 | B2 * | 2/2010 | Kaneko | B41J 2/1404 347/40 |
| 7,837,303 | B2 | 11/2010 | Bengali | |
| 8,043,517 | B2 | 10/2011 | Gu et al. | |
| 8,158,336 | B2 | 4/2012 | Bell et al. | |
| 2004/0165036 | A1 | 8/2004 | Lee et al. | |
| 2004/0196335 | A1 | 10/2004 | Stout et al. | |
| 2007/0002098 | A1 | 1/2007 | Park et al. | |
| 2008/0198200 | A1 | 8/2008 | Tsuruko | |
| 2012/0293587 | A1 | 11/2012 | Bakker | |

FOREIGN PATENT DOCUMENTS

| | | |
|---|---|---|
| CN | 101077652 | 12/2010 |
| EP | 0355862 | 2/1990 |
| JP | 2012091380 | 5/2012 |
| TW | 200711862 | 4/2007 |
| WO | WO-2012105935 | 8/2012 |

* cited by examiner

View A-A
from FIG. 2

View F-F

FLUID EJECTION DEVICE WITH PARTICLE TOLERANT LAYER EXTENSION

BACKGROUND

Fluid ejection devices in inkjet printers provide drop-on-demand ejection of fluid drops. Inkjet printers produce images by ejecting ink drops from ink-filled chambers through nozzles onto a print medium, such as a sheet of paper. The nozzles are typically arranged in one or more arrays, such that properly sequenced ejection of ink drops from the nozzles causes characters or other images to be printed on the print medium as the printhead and the print medium move relative to each other. In a specific example, a thermal inkjet printhead ejects drops from a nozzle by passing electrical current through a heating element to generate heat and vaporize a small portion of the fluid within the ink-filled chamber. In another example, a piezoelectric inkjet printhead uses a piezoelectric material actuator to generate pressure pulses that force ink drops out of a nozzle.

Rapidly refilling the chambers with ink enables increased printing speeds. However, as ink flows into the chambers from a reservoir, small particles in the ink can get lodged in and around the channel inlets that lead to the chambers. These small particles can diminish and/or completely block the flow of ink to the chambers, which can result in the premature failure of heating elements, reduced ink drop size, misdirected ink drops, and so on. As small particles inhibit ink flow to more and more chambers, the resultant failures in corresponding nozzles can noticeably reduce the print quality of a printer.

BRIEF DESCRIPTION OF THE DRAWINGS

The present embodiments will now be described, by way of example, with reference to the accompanying drawings, in which.

DETAILED DESCRIPTION

Overview

Figure 1A:
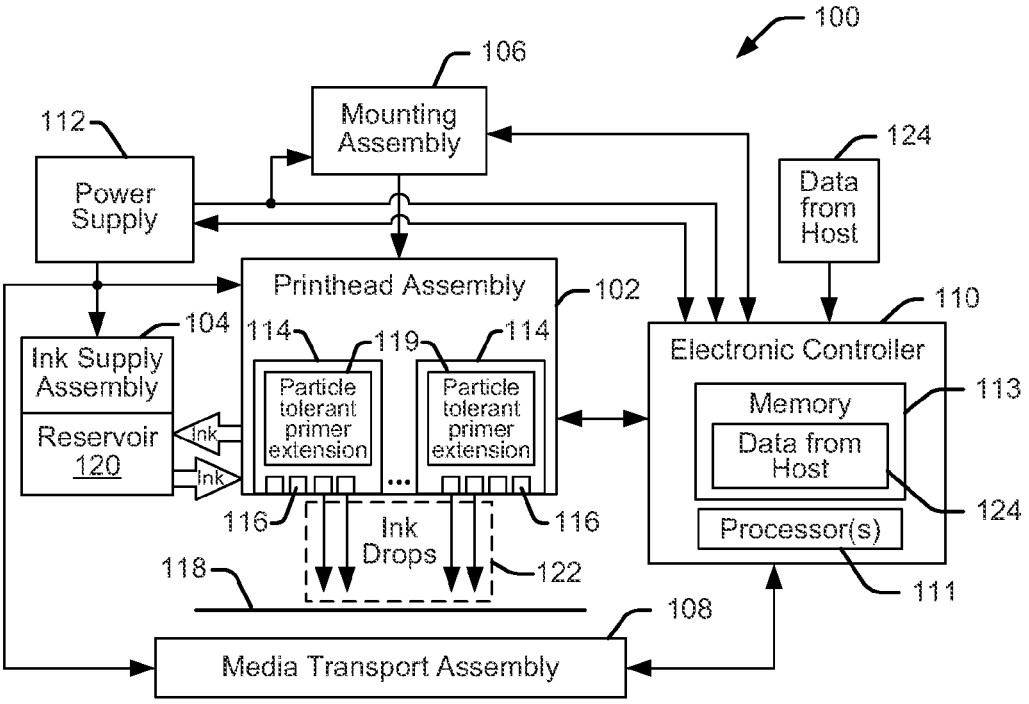
FIG. 1*a* illustrates a fluid ejection system implemented as an inkjet printing system, according to an embodiment.

As noted above, small particles within the fluid ink of inkjet printheads (and other fluid ejection devices) can reduce and/or block the flow of ink into the ink firing chambers, which can reduce the overall print quality in inkjet printers. There are a number of potential sources for the small particles carried within the ink, including ink storage mechanisms such as porous foam material, and materials used in the printhead manufacturing process (e.g., SiN particles from the backside wet etch mask process on the printhead). In one example, the processing of a thin-film layer can leave behind tantalum (Ta) or other metal filaments along the edges of the thin-film layer. The Ta filaments can break off the edges of the thin-film layer, producing both long and short particles that can block the flow of ink. In some cases, longer particles from these sources can block the flow of ink into multiple adjacent chambers and their corresponding nozzles. In such cases, long particles carried by the ink can become lodged on an ink feed hole shelf and across multiple adjacent channel inlets that lead to multiple adjacent corresponding ink chambers. The diminished or blocked ink flow into multiple adjacent ink firing chambers can cause multiple adjacent corresponding nozzles to either not fire ink drops, or to fire misdirected or reduced-size ink drops. These circumstances can cause inkjet printers to produce printed pages that have missing portions of text and/or images and other similar noticeable print defects.

Previous approaches for dealing with defects caused by such ink blockages include the use of scanning print modes that enable multiple print passes. While a scanning print mode that uses multiple passes to compensate for defective/blocked nozzles is generally effective, it is not applicable in single-pass print modes (i.e., with page wide array printers), and it has the drawback of decreasing the print speed. Another solution is to employ spare or redundant nozzles. Redundant nozzles can be used in both scanning print modes and single-pass print modes. While the use of redundant nozzles can also effectively compensate for defective/blocked nozzles, this solution adds cost and reduces print resolution by the number of redundant nozzles being used.

Other approaches to dealing with defects from ink blockages include the use of multiple channel inlets that lead to the ink firing chambers, which reduces the chances that ink flow to the chambers will be blocked. Still other approaches include the use of barriers that prevent particles from reaching the channel inlets leading to the ink firing chambers. Such barriers can include pillar structures located near the channel inlets. The placement, size, and spacing of the pillars are generally designed to prevent particles of the smallest anticipated size from blocking the inlets to channels that lead to the ink firing chambers. These latter approaches, while beneficial in reducing blockage caused by small particles, are generally less effective for preventing ink blockage caused by longer particles that become lodged on the ink feed hole shelf across multiple adjacent channel inlets, as in the circumstances noted above.

Embodiments of the present disclosure help prevent particles, including long filament, metal, and fiber particles, from blocking fluid flow in fluid ejection devices such as inkjet printheads, by employing a particle tolerant architecture that extends an existing primer layer into a fluid slot. While prior particle tolerant architectures prevent smaller particles in the fluid from entering fluid channel inlets that lead to fluidic chambers, the disclosed primer layer extension also prevents longer particles from settling length-wise on a shelf region in front of the channel inlets that lead to fluid chambers. The long particles are therefore prevented from blocking fluid flow into the fluid chambers. In addition to forming particle tolerant architectures that extend into the fluid slot and prevent particles from blocking fluid flow, the primer layer extension also forms a coating over the edges of the thin-film layer. The extension of the primer layer over the etched edges of the thin-film layer coats the thin-film edges and prevents Ta or other metal filaments from breaking off the edges. The primer layer coating over the thin-film edges eliminates a potential source of both long and short particles that can block the flow of ink in the fluid ejection device.

In one example, a fluid ejection device includes a thin-film layer formed over a substrate. A primer layer is formed over the thin-film layer, and a chamber layer is formed over the primer layer that defines a fluidic channel leading to a firing chamber. The fluid ejection device includes a slot that extends through the substrate and into the chamber layer through an ink feed hole in the thin-film layer. The fluid ejection device also includes a particle tolerant extension of the primer layer that protrudes into the slot. In some implementations, the particle tolerant primer layer extension extends across a full width of the slot.

In another example, a fluid ejection device includes a thin-film layer formed over a substrate. A chamber layer is formed over the thin-film layer, and an ink feed hole is formed through the thin-film layer. The ink feed hole fluidically couples a slot between the substrate and chamber layer. The fluid ejection device also includes an SU-8 primer layer over the thin-film layer that extends into the slot and over edges of the ink feed hole to coat the edges of the ink feed hole.

Illustrative Embodiments

FIG. 1*a* illustrates a fluid ejection system implemented as an inkjet printing system 100, according to an embodiment of the disclosure. Inkjet printing system 100 generally includes an inkjet printhead assembly 102, an ink supply assembly 104, a mounting assembly 106, a media transport assembly 108, an electronic controller 110, and at least one power supply 112 that provides power to the various electrical components of inkjet printing system 100. In this embodiment, fluid ejection devices 114 are implemented as fluid drop jetting printheads 114 (i.e., inkjet printheads 114). Inkjet printhead assembly 102 includes at least one fluid drop jetting printhead 114 that ejects drops of ink through a plurality of orifices or nozzles 116 toward print media 118 so as to print onto the print media 118. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other. Print media 118 can be any type of suitable sheet or roll material, such as paper, card stock, transparencies, Mylar, and the like. As discussed further below, each printhead 114 comprises a particle tolerant primer layer extension 119 that extends a primer layer out into the fluid slot area to prevent particles from blocking ink flow into the fluidic architectures (e.g., fluidic channels and chambers) of the chamber layer.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a macro-recirculating ink delivery system. In a one-way ink delivery system, substantially all of the ink supplied to inkjet printhead assembly 102 is consumed during printing. In a macro-recirculating ink delivery system, however, only a portion of the ink supplied to printhead assembly 102 is consumed during printing. Ink not consumed during printing is returned to ink supply assembly 104.

Figure 1B:
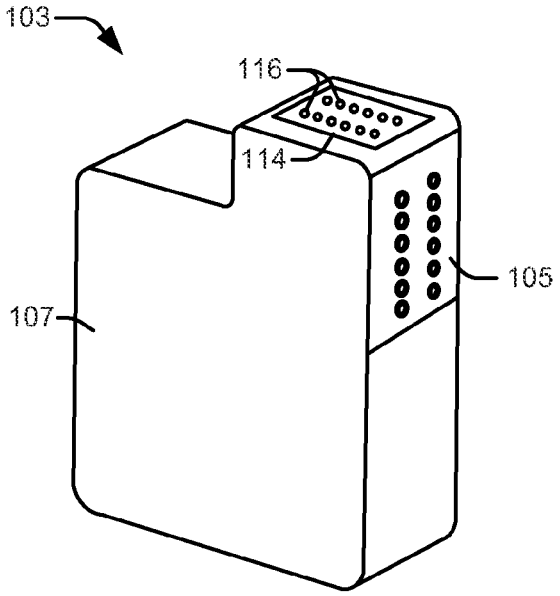
FIG. 1*b* shows a perspective view of an example inkjet cartridge that includes an inkjet printhead assembly and ink supply assembly, according to an embodiment.

In some implementations, inkjet printhead assembly 102 and ink supply assembly 104 (including reservoir 120) are housed together in a replaceable device such as an integrated inkjet printhead cartridge or pen 103, as shown in FIG. 1*b*. FIG. 1*b* shows a perspective view of an example inkjet cartridge 103 that includes inkjet printhead assembly 102 and ink supply assembly 104, according to an embodiment of the disclosure. In addition to one or more printheads 114, inkjet cartridge 103 includes electrical contacts 105 and an ink (or other fluid) supply chamber 107. In some implementations cartridge 103 may have a single supply chamber 107 that stores one color of ink, and in other implementations it may have a number of chambers 107 that each store a different color of ink. Electrical contacts 105 carry electrical signals to and from controller 110, for example, to cause the ejection of ink drops through nozzles 116.

In other implementations, ink supply assembly 104 is separate from inkjet printhead assembly 102 and it supplies ink to inkjet printhead assembly 102 through an interface connection, such as a supply tube. In either implementation, reservoir 120 of ink supply assembly 104 may be removed, replaced, and/or refilled. Where inkjet printhead assembly 102 and ink supply assembly 104 are housed together in an inkjet cartridge 103, reservoir 120 can include a local reservoir located within the cartridge as well as a larger reservoir located separately from the cartridge. A separate, larger reservoir serves to refill the local reservoir. Accordingly, a separate, larger reservoir and/or the local reservoir may be removed, replaced, and/or refilled.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one implementation, inkjet printhead assembly 102 is a scanning type printhead assembly that includes one printhead 114. As such, mounting assembly 106 includes a carriage for moving inkjet printhead assembly 102 relative to media transport assembly 108 to scan print media 118. In another implementation, inkjet printhead assembly 102 is a non-scanning type printhead assembly with multiple printheads 114, such as a page wide array (PWA) print bar, or carrier. A PWA print bar print bar carries the printheads 114, provides electrical communication between the printheads 114 and electronic controller 110, and provides fluidic communication between the printheads 114 and the ink supply assembly 104. Thus, mounting assembly 106 fixes inkjet printhead assembly 102 at a prescribed position while media transport assembly 108 positions and moves print media 118 relative to inkjet printhead assembly 102.

In one implementation, inkjet printing system 100 is a drop-on-demand thermal bubble inkjet printing system comprising thermal inkjet (TIJ) printhead(s). The TIJ printhead implements a thermal resistor ejection element in an ink chamber to vaporize ink and create bubbles that force ink or other fluid drops out of a nozzle 116. In another implementation, inkjet printing system 100 is a drop-on-demand piezoelectric inkjet printing system where the printhead(s) 114 is a piezoelectric inkjet (PIJ) printhead that implements a piezoelectric material actuator as an ejection element to generate pressure pulses that force ink drops out of a nozzle.

Electronic controller 110 typically includes one or more processors 111, firmware, software, one or more computer/processor-readable memory components 113 including volatile and non-volatile memory components (i.e., non-transitory tangible media), and other printer electronics for communicating with and controlling inkjet printhead assembly 102, mounting assembly 106, and media transport assembly 108. Electronic controller 110 receives data 124 from a host system, such as a computer, and temporarily stores data 124 in a memory 113. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one implementation, electronic controller 110 controls inkjet printhead assembly 102 for ejection of ink drops from nozzles 116. Thus, electronic controller 110 defines a patter of ejected ink drops that form characters, symbols, and/or other graphics or images on print media 118. The pattern of ejected ink drops is determined by the print job commands and/or command parameters.

Figure 2:
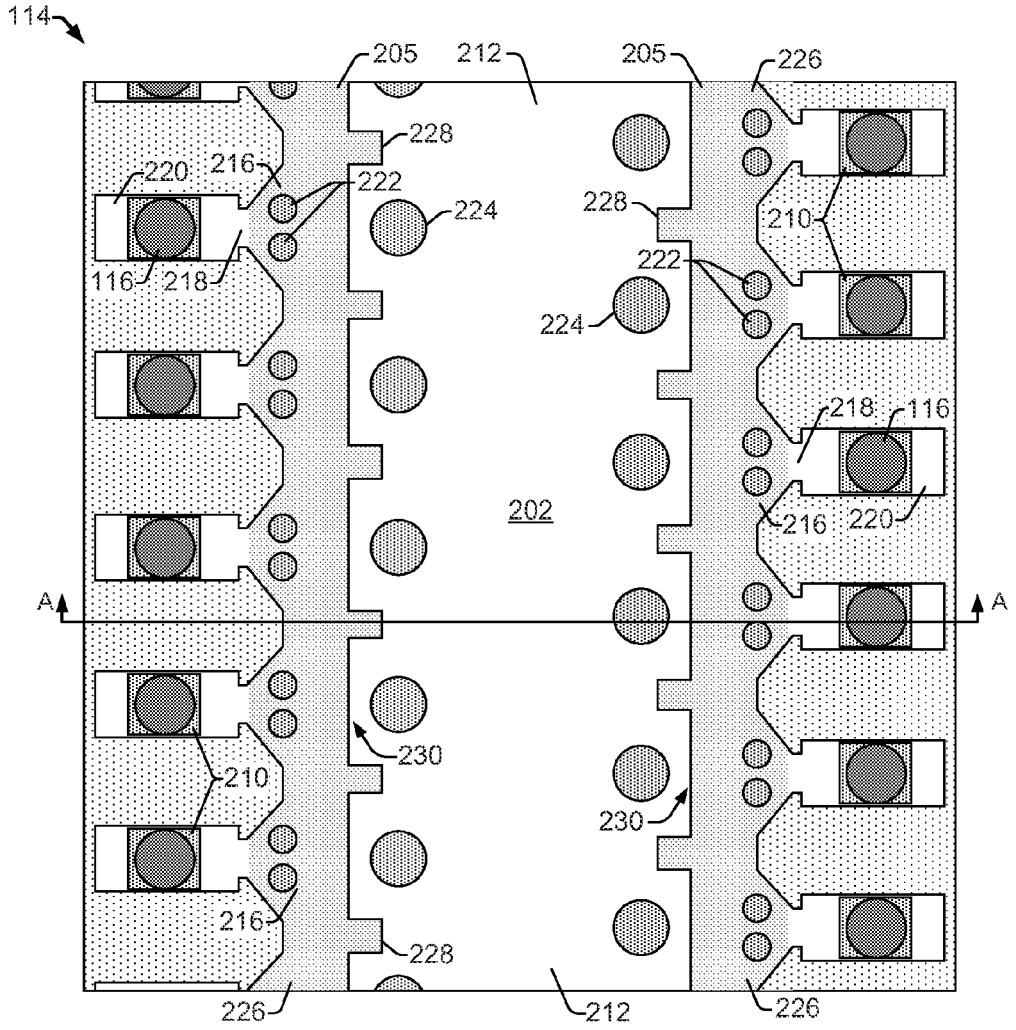
FIG. 2 shows a plan view of a portion of an example fluid ejection device, according to an embodiment.
Figure 3:
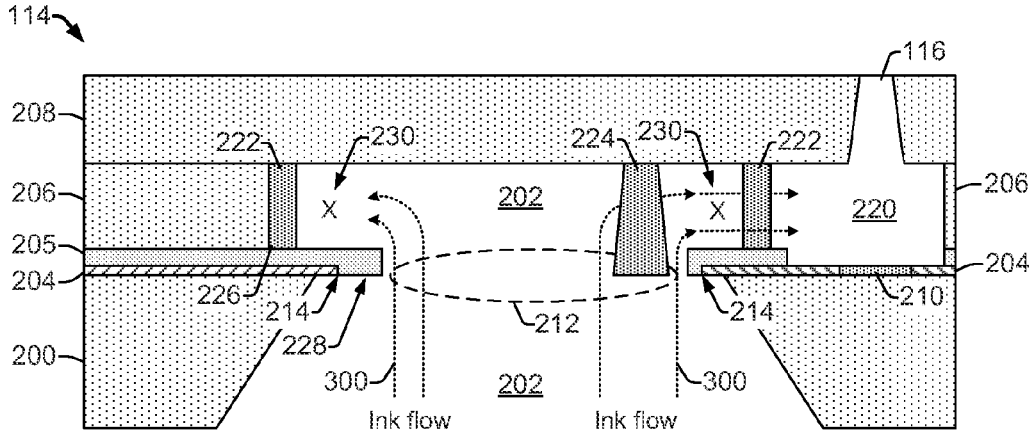
FIG. 3 shows a side view taken from the example fluid ejection device shown in FIG. 2, according to an embodiment.

FIG. 2 shows a plan view of a portion of an example fluid ejection device 114 i.e., printhead 114), according to an embodiment of the disclosure. The portion of printhead 114 shown in FIG. 2 illustrates architectural features from each of several different layers of the printhead 114. The different layers, components, and architectural features of printhead 114 can be formed using various precision microfabrication and integrated circuit fabrication techniques such as electroforming, laser ablation, anisotropic etching, sputtering, spin coating, dry film lamination, dry etching, photolithography, casting, molding, stamping, machining, and the like. FIG. 3 shows a side view (view A-A) taken from the example fluid ejection device 114 shown in FIG. 2.

Referring generally to both FIGS. 2 and 3, printhead 114 is formed in part, of a layered architecture that includes a substrate 200 (e.g., glass, silicon) with a fluid slot 202, or trench, formed therein. Running along either side of the slot 202 are columns of fluid drop ejectors that generally comprise thermal resistors 210, fluid chambers 220, and nozzles 116. Formed over the substrate 200 is a thin-film layer 204, a primer layer 205, a chamber layer 206, and a nozzle layer 208. The thin-film layer 204 implements thin film thermal resistors 210 and associated electrical circuitry such as drive circuits and addressing circuits (not shown) that operate to eject fluid drops from printhead 114. During processing of printhead 114, the removal (e.g., etching) of a portion of thin-film layer 204 creates on ink feed hole (IFH) 212 (shown as a dotted ellipse in FIG. 3) between the substrate 200 and the chamber layer 206. The IFH 212 allows fluid flow between the substrate and chamber layer by enabling an extension of the slot 202 into the chamber layer 206 from the substrate 200. Thus, the thin-film layer 204 can also be referred to as the ink feed hole layer 204. The dotted lines 300 with arrows in FIG. 3 show the general direction of ink flow through the slot 202 from the substrate 200 and into the chamber layer 206. In FIG. 2, this flow of ink through the slot 202 from the substrate 200 and into the chamber layer 206 would be a flow that proceeds in a direction out of the page, toward the viewer. The flow would then proceed to the left and right between particle tolerant pillars (222, 224), through channel inlets 216 and fluidic channels 218, and into fluid chambers 220.

In the example implementation shown in FIGS. 2 and 3, thermal resistors 210 are formed in the thin-film layer 204 and located in columnar arrays along either side of the slot 202 and edges 214 of the ink feed hole 212. The thin-film layer 204 comprises a number of different layers (not illustrated individually) that include, for example, an oxide layer, a metal (e.g., tantalum) layer that defines the thermal resistors 210 and conductive traces (not shown), and a passivation layer. A passivation layer can be formed of several materials, such as silicon oxide, silicon carbide, and silicon nitride.

The primer layer 205 formed over thin-film layer 204 is typically formed of a photo-definable epoxy such as SU8 epoxy, which is a polymeric material commonly used in the fabrication of microfluidic and MEMS devices. Primer layer 205 can also be made of other materials such as a polyimide, a deposited dielectric material, a plated metal, and an on. The Chamber layer 206 formed over thin-film layer 204 and primer layer 205, includes a number of fluidic features such as channel inlets 216 that lead to fluidic channels 218 and the fluid/ink firing chambers 220. As shown in FIGS. 2 and 3, the fluidic firing chambers 220 are formed around and over corresponding thermal resistors 210 (ejection elements). Like primer layer 205, the chamber layer 206 is typically formed of SU8 epoxy, but can also be made of other materials such as a polyimide.

In some implementations, the chamber layer 206 also includes particle tolerant architectures in the form of particle tolerant pillars (222, 224). On-shelf pillars 222, formed during the fabrication of chamber layer 206, are located on a shelf 226 of the chamber layer 206 near the channel inlets 216. The on-shelf pillars 222 help prevent small particles in the ink from entering the channel inlets 216 and blocking ink flow to chambers 220. Off-shelf pillars 224, or hanging pillars 224, are also formed during the fabrication of chamber layer 206. The hanging pillars 224 are formed prior to formation of the slot 202, and they are adhered to the nozzle layer 208. Thus, when slot 202 is formed, hanging pillars 224 effectively "hang" in place through their adherence to the nozzle layer 208. Both the on-shelf pillars 222 and hanging pillars 224 help stop small particles from entering the channel inlets 216 and blocking ink flow to chambers 220.

Nozzle layer 208 is formed on the chamber layer 206 and includes nozzles 116 that each correspond with a respective chamber 220 and thermal resistor ejection element 210. The nozzle layer 208 forms a top over the slot 202 and other fluidic features of the chamber layer 206 (e.g., the channel inlets 216, fluidic channels 218, and the fluid/ink firing chambers 220). The nozzle layer 208 is typically formed of SU8 epoxy, but it can also be made of other materials such as a polyimide.

In addition to the particle tolerant pillars 222, 224, printhead 114 also includes a particle tolerant primer layer extension 228. The particle tolerant primer layer extension 228 comprises an extension of the primer layer 205 out from between the thin-film layer 204 and chamber layer 206, and into the area of the slot 202. In general, the particle tolerant primer layer extension 228 enhances the ability of the printhead 114 to manage small particles within the ink and prevent them from diminishing or blocking ink flow to the chambers 220. More specifically, however, the particle tolerant primer layer extension 228 prevents longer particles from settling length-wise in the fluidic shelf region 230 located in front of the channel inlets 216 that lead to fluid chambers 220. In FIG. 3, this the fluidic shelf region 230 is labeled with an "X", and it lies between the on-shelf pillars 222 and the hanging pillars 224.

Figure 4:
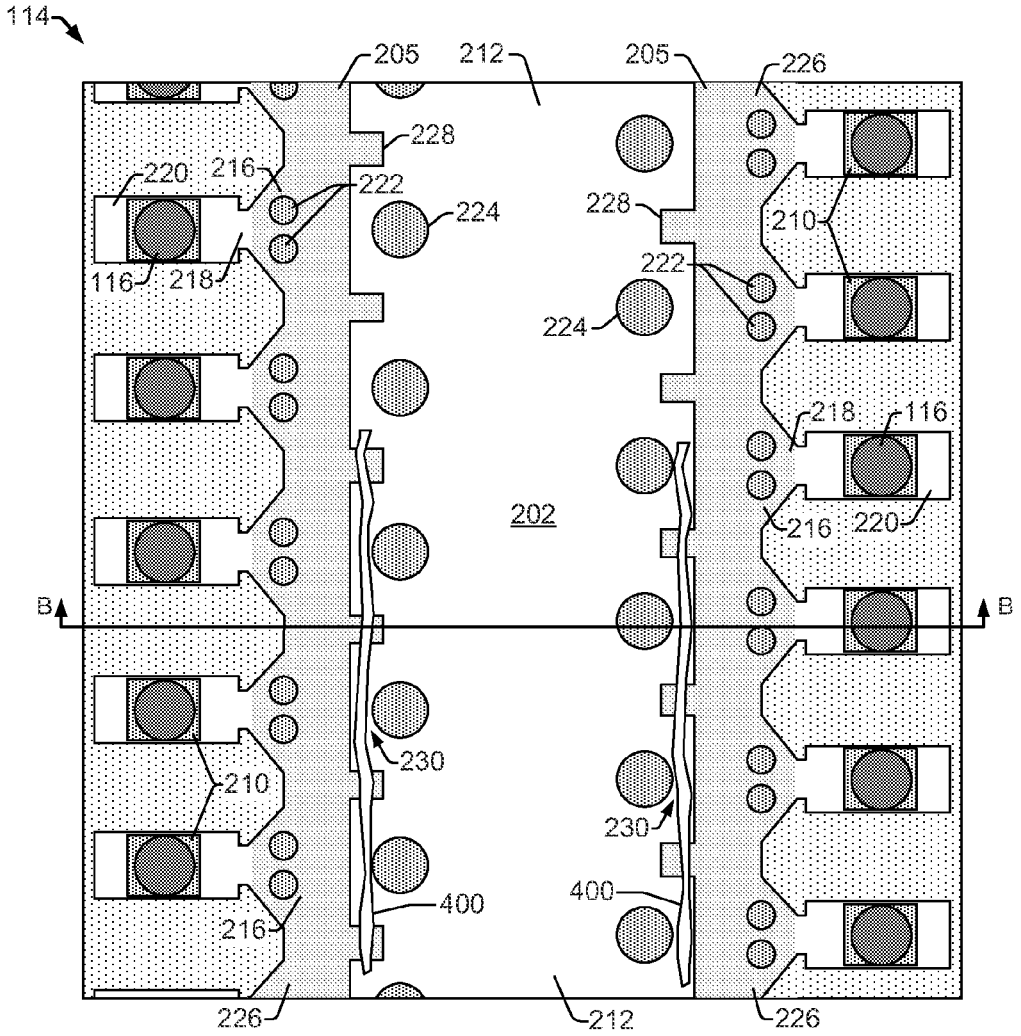
FIG. 4 shows a plan view of a portion of an example fluid ejection device illustrating how a particle tolerant primer layer extension prevents a long particle from blocking ink flow to fluid chambers, according to an embodiment.
Figure 5:
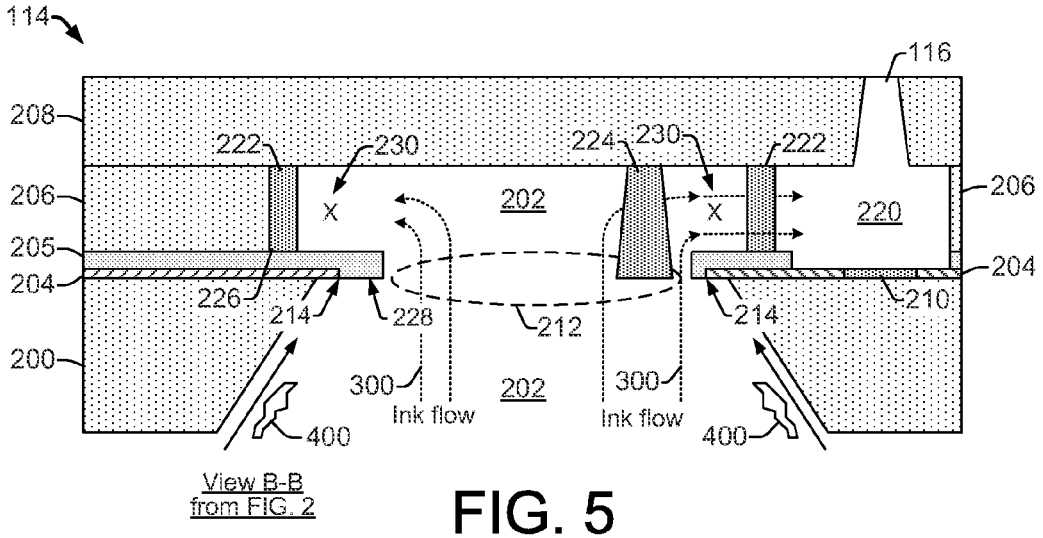
FIG. 5 shows a side view taken from the example fluid ejection device shown in FIG. 4, according to an embodiment.

FIG. 4 shows a plan view of a portion of an example fluid ejection device 114 (i.e., printhead 114) illustrating how a particle tolerant primer layer extension 228 prevents a long particle 400 from blocking ink flow to fluid chambers 220, according to an embodiment of the disclosure. FIG. 5 shows a side view (view B-B) taken from the example fluid ejection device 114 shown in FIG. 4. The printheads 114 in FIGS. 4 and 5 are the same as or similar to those shown in FIGS. 2 and 3, except that they include an illustration of how the particle tolerant primer layer extension 228 functions to prevent long particles 400 from blocking or diminishing ink flow to the printhead ink chambers 220.

Referring to FIGS. 4 and 5, long particles 400 within fluid ink can travel through the fluid slot 202 in the general direction 300 of the ink flow. The long particles can travel along the sides of the slot 202 toward the fluidic shelf region 230 (FIG. 5; marked "X") of the chamber layer 206 near the channel lets 216 that lead to fluid chambers 220. If the long particles 400 come to rest, or get lodged in the fluidic shelf region 230, they can block the flow of ink into the channel inlets 216 that lead to fluid chambers 220. As is apparent from FIG. 4, multiple adjacent channel inlets 216 can be blocked by such long particles 400. However, as FIG. 4 also shows, the particle tolerant primer layer extension 228 prevents the long particles 400 from reaching the fluidic shelf region 230.

FIGS. 2-5 show one of various possible designs of a particle tolerant primer layer extension 228. In particular, the particle tolerant primer layer extension 228 of FIGS. 2-5 comprises a plurality of finger-like, protrusions that are partially interleaved between the hanging pillars 224. The interleaving of the protrusions in the particle tolerant primer layer extension 228 with the hanging pillars 224 prevents the long particles 400 from coming to rest or lodging in the fluidic shelf region 230 between the on-shelf pillars 222 and the hanging pillars 224. However, various other designs of a particle tolerant primer layer extension 228 are possible and are contemplated by this disclosure, that can achieve a similar result of preventing long particles from coming to rest or lodging in the fluidic shelf region 230 between the on-shelf pillars 222 and the hanging pillars 224.

Figure 6:
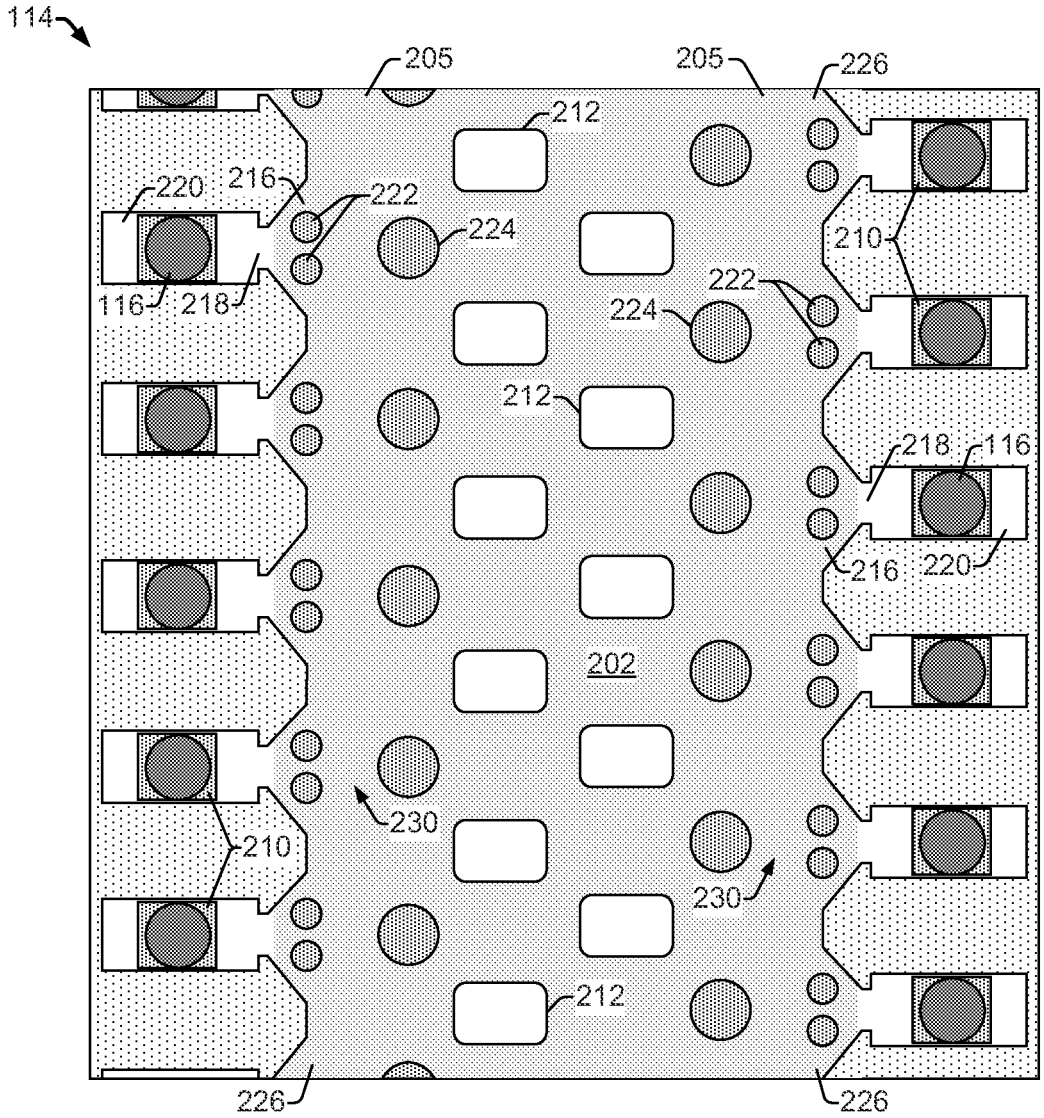
FIG. 6 shows a plan view of a portion of an example fluid ejection device with a varying design of a particle tolerant primer layer extension, according to an embodiment.
Figure 7:
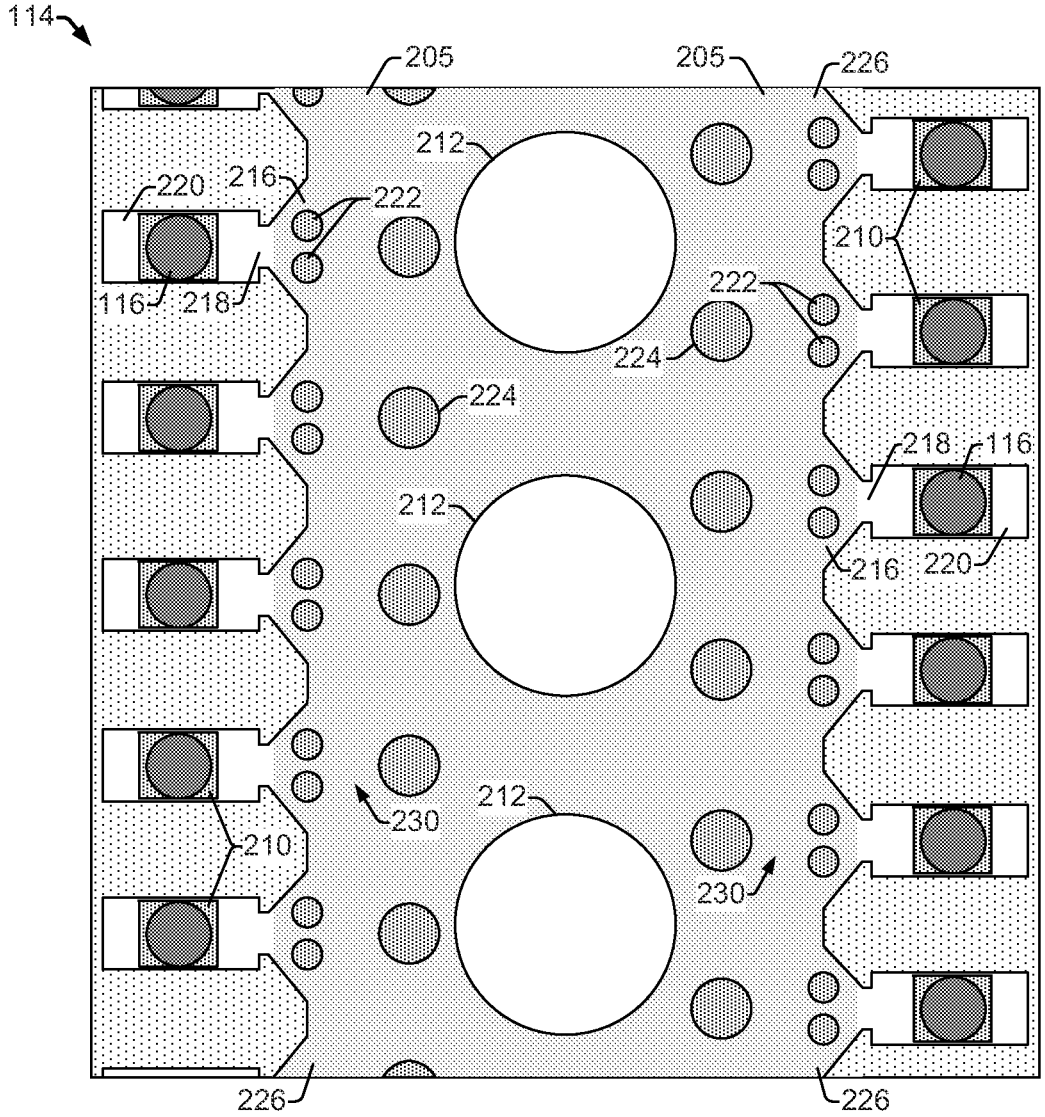
FIG. 7 shows a plan view of a portion of an example fluid ejection device with a varying design of a particle tolerant primer layer extension, according to an embodiment.
Figure 8:
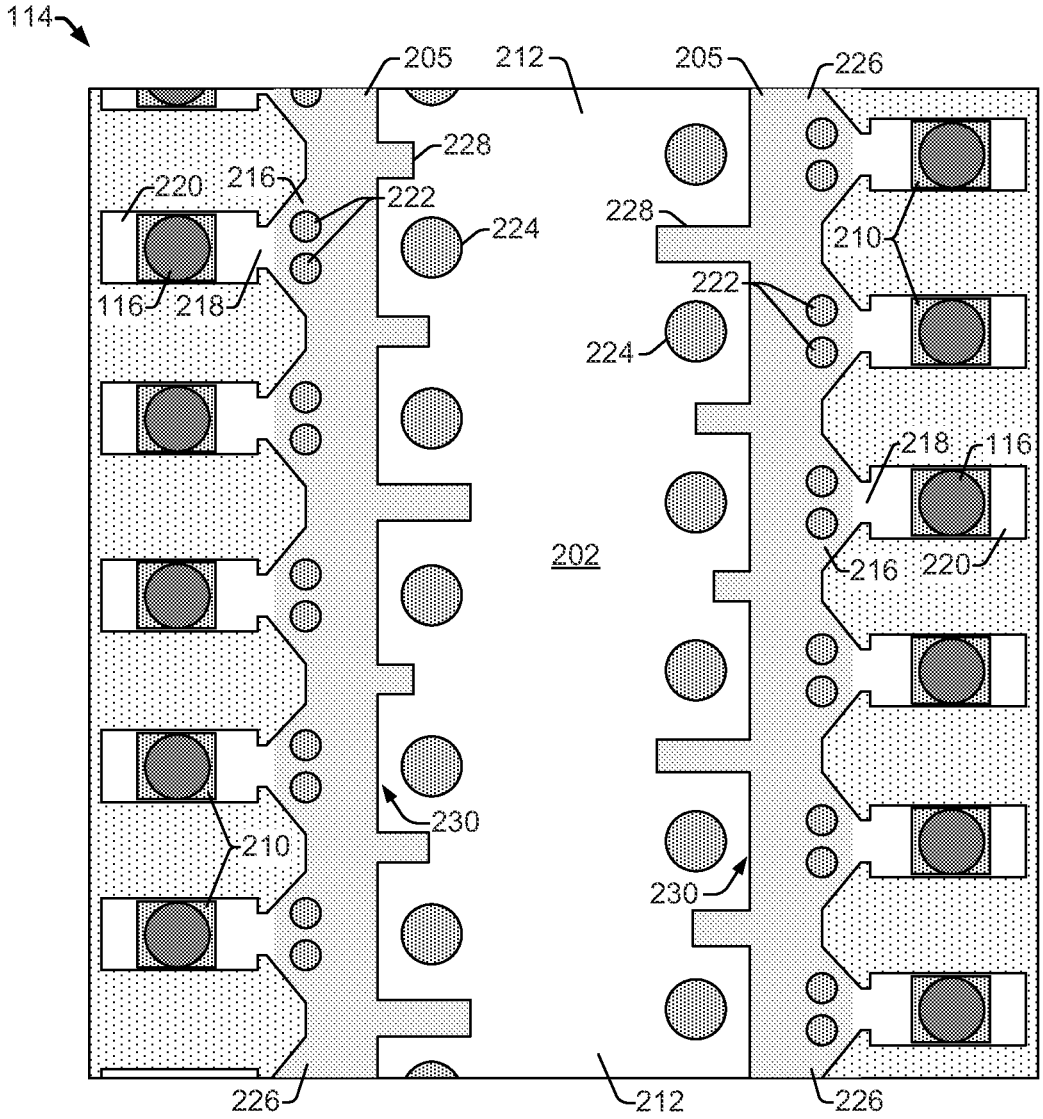
FIG. 8 shows a plan view of a portion of an example fluid ejection device with a varying design of a particle tolerant primer layer extension, according to an embodiment.

FIGS. 6-8 show plan views of a portion of example fluid ejection devices 114 (i.e., printhead 114) with varying designs of particle tolerant primer layer extensions 228, according to embodiments of the disclosure. As shown in FIG. 6, the primer layer 205 can protrude from between the thin-film layer 204 and chamber layer 206 as a particle tolerant primer layer extension 228 that extends all the way across the slot 202. That is, the particle tolerant primer layer extension 228 spans the entire width of the slot 202 between the columns of fluid drop ejectors located on either side of the slot 202. In this illustration, the slot 202 extends both above and below the particle tolerant primer layer extension 228. That is, although the substrate 200 and chamber layer 206 are not specifically shown in FIG. 6, the slot 202 still extends through both the substrate 200 and the chamber layer 206, as in the previous design. However, instead of having a singular large ink feed hole 212 as shown in FIGS. 2-5, the FIG. 6 design comprises multiple ink feed holes 212 formed in the particle tolerant primer layer extension 228 that enable fluid ink to flow through the slot 202 between the substrate and the chamber layer 206. While the multiple ink feed holes 212 in the FIG. 6 design are rectangular in shape, other shapes are possible that may provide the same benefits of preventing long particles from coming to rest or lodging in the fluidic shelf region 230 between the on-shelf pillars 222 and the hanging pillars 224.

FIG. 7 shows another example printhead 114 with a different design of a particle tolerant primer layer extension 228 that is similar to the design of FIG. 6. Like in FIG. 6, the particle tolerant primer layer extension 228 of FIG. 7 extends all the way across the slot 202. In addition, instead of having a singular large ink feed hole 212 as shown in FIGS. 2-5, the FIG. 7 design comprises multiple ink feed holes 212 in the particle tolerant primer layer extension 228 that enable fluid ink to flow through the slot 202 between the substrate and the chamber layer 206 (not specifically shown in FIG. 7). The multiple ink feed holes 212 in the particle tolerant primer layer extension 228 of FIG. 7, however, are both fewer and larger than the ink feed holes 212 in FIG. 6. The larger ink feed holes 212 in FIG. 7 are circular, but may in other examples be shaped differently to provide the benefits of preventing long particles from coming to rest or lodging in the fluidic shelf region 230 between the on-shelf pillars 222 and the hanging pillars 224.

FIG. 8 shows another example printhead 114 with a different design of a particle tolerant primer layer extension 228 that is similar to the design shown in FIGS. 2-5. As in the design shown in FIGS. 2-5, the particle tolerant primer layer extension 228 of FIG. 8 does not extend all the way across the slot 202, and there is generally, a singular large ink feed hole 212 similar to that of the design in FIGS. 2-5. In FIG. 8, the particle tolerant primer layer extension 228 comprises a plurality of finger-like, protrusions that are partially interleaved between the hanging pillars 224. However, the particle tolerant primer layer extension 228 protrusions in the FIG. 8 design extend into the slot 202 in varying lengths. That is, the protrusions 228 in FIG. 8 are not the same length as is generally the case with the design shown in FIGS. 2-5. However, like the design shown in FIGS. 2-5, the particle tolerant primer layer extension 228 protrusions of varying lengths in the FIG. 8 design are interleaved with the hanging pillars 224 to prevent long particles 400 from corning to rest or lodging in the fluidic shelf region 230 between the on-shelf pillars 222 and the hanging pillars 224.

While various other designs of a particle tolerant primer layer extension 228 are possible and are contemplated by this disclosure, it is noted that different designs may provide varying degrees of robustness associated with the particle tolerant primer layer extension 228 itself. For example, the shorter particle tolerant primer layer extension 228 protrusions shown in FIGS. 2-5 may be more robust and therefore less prone to damage than the longer particle tolerant primer layer extension 228 protrusions shown in FIG. 8. Likewise, the particle tolerant primer layer extension 228 that extend all the way across the slot 202 as shown in FIGS. 6 and 7, may be more robust and less prone to damage than the longer particle tolerant primer layer extension 228 protrusions shown in FIG. 8.

Figure 9:
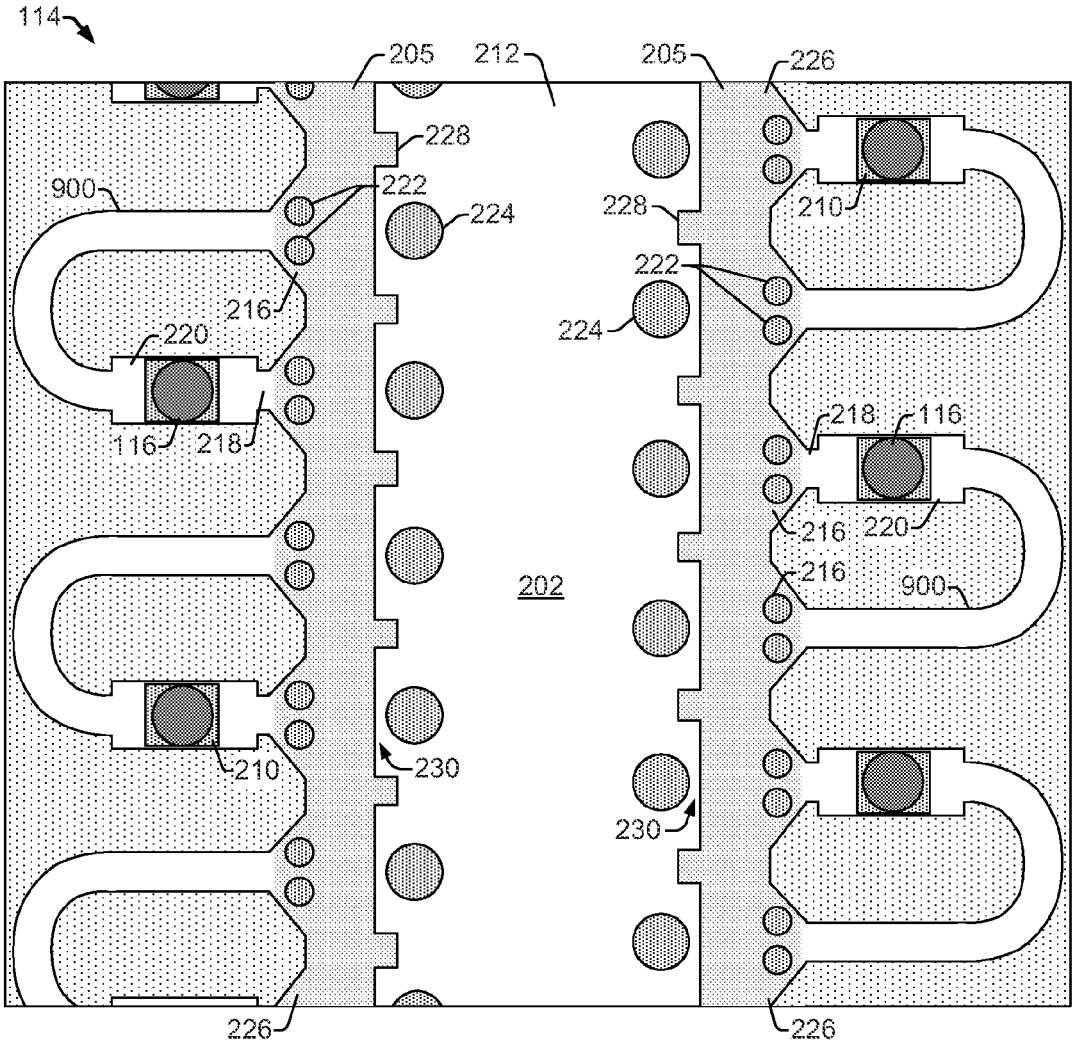
FIG. 9 shows a plan view of a portion of an example fluid ejection device comprising a recirculation channel and a particle tolerant primer layer extension, according to an embodiment.

FIG. 9 shows a plan view of a portion of an example fluid ejection device 114 (i.e., printhead 114) comprising a recirculation channel and a particle tolerant primer layer extension 228, according to an embodiment of the disclosure. In each of the printheads 114 discussed above with regard to FIGS. 2-8, the general fluidic architecture of the chamber layer 206 comprises a single channel inlet 216 in communication with a single fluidic channel 212 that leads to a fluid chamber 220. However, the various designs of a particle tolerant primer layer extension 228 are also applicable to printheads 114 having recirculation channels 900 (and other fluidic architectures) that circulate ink through the fluid chamber 220 between two channel inlets 216.

As shown in FIG. 9, for example, the chamber layer 206 (not specifically shown) defines a recirculation channel 900 that enables ink circulation through the fluid chamber 220 between two channel inlets 216 that are in fluid communication with the slot 202. As in the previous examples that each comprise single channel inlets 216, a particle tolerant primer layer extension 228 employed in the example of FIG. 9 functions in a similar manner as discussed above to prevent long particles from coming to rest or lodging in the fluidic shelf region 230 between the on-shelf pillars 222 and the hanging pillars 224. Thus, the particle tolerant primer layer extension 228 prevents the long particles from inhibiting ink flow at both channel inlets 216 associated with the recirculation channels 900 in the example printhead 114 of FIG. 9.

In addition to preventing particles from lodging in the fluidic shelf region 230 and blocking ink flow to chambers 220, the particle tolerant primer layer extension 228 also serves to coat the edges of the thin-film layer 204. As noted above, the processing of the thin-film layer 204 during fabrication of the printhead 114 can leave behind tantalum (Ta) or other metal filaments along the edges 214 (FIGS. 3, 5) of the thin-film layer 204. The Ta filaments can break off the edges 214 of the thin-film layer 204, producing both long and short particles that can block the flow of ink.

Figure 10:
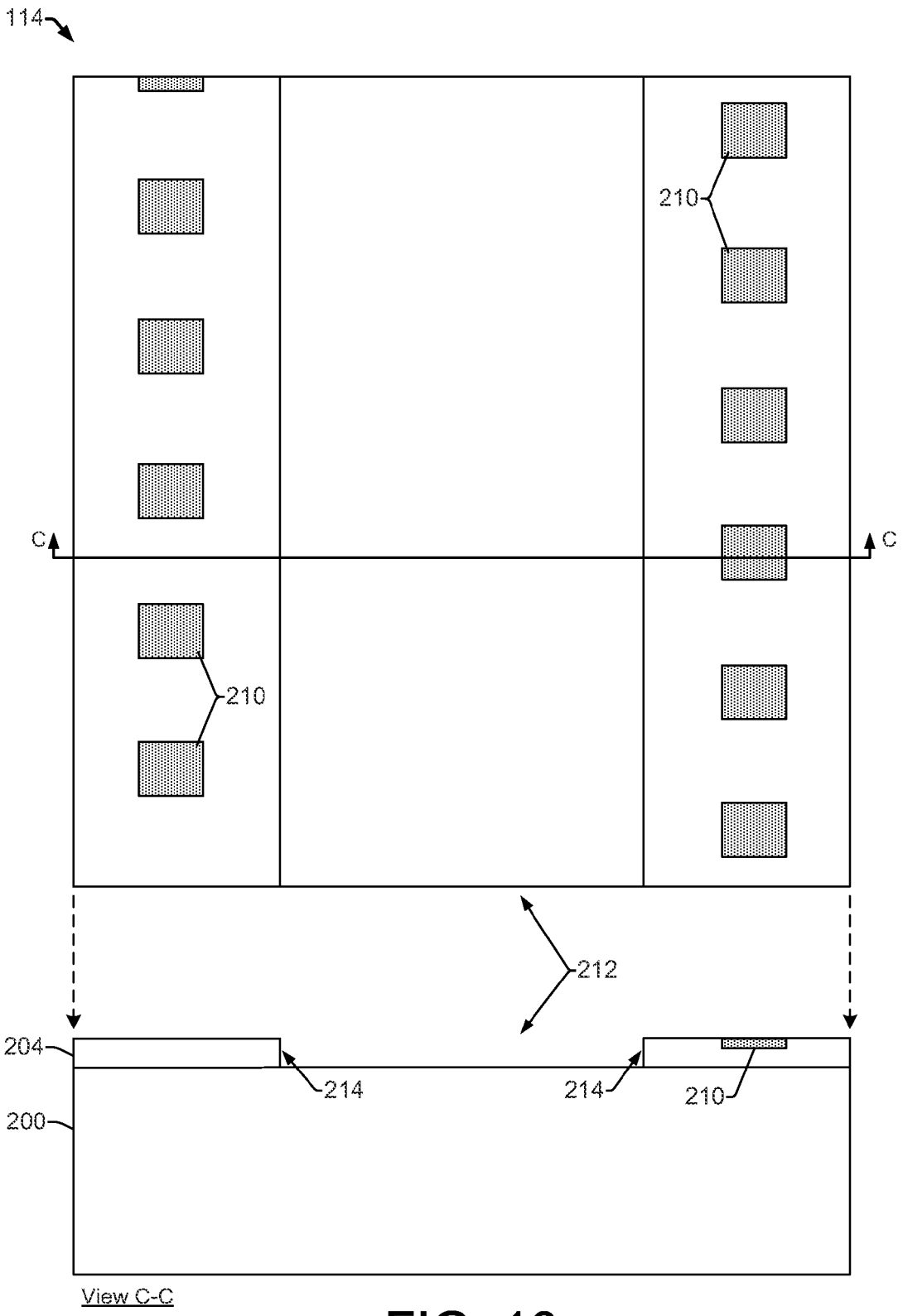
FIGS. 10-13 show processing steps that illustrate how a particle tolerant primer layer extension coats the edges of a thin-film layer, according to embodiments.

FIGS. 10-13 show several basic processing steps that illustrate how the particle tolerant primer layer extension 228 coats the edges 214 of the thin-film layer 204, according to embodiments of the disclosure. FIG. 10 shows plan view and cross sectional view (across line C-C) of a portion of an example fluid ejection device 114 (i.e., printhead 114), according to an embodiment of the disclosure. In an initial processing step, as shown in FIG. 10, a thin-film layer 204 is formed on the substrate 200 (e.g., silicon). The thin-film layer 204 typically comprises a number of different layers (not illustrated individually) that include, for example, an oxide layer, a metal (e.g., tantalum) layer that defines the thermal resistors 210 and conductive traces (not shown), and a passivation layer. The thin-film layer 204 can be formed using various microfabrication and integrated circuit fabrication techniques such as electroforming, laser ablation, anisotropic etching, sputtering, spin coating, dry film lamination, dry etching, photolithography, casting, molding, stamping, machining, and the like. After the thin-film layer 204 is formed on substrate 200, a latent ink feed hole (IFH) 212 is formed by removing an area of the thin-film layer 204. Removal of an area of the thin-film layer 204 is typically achieved by etching. Etching the thin-film layer 204 results in edges 214 that can have metal filaments (e.g., Ta filaments) that are left by the etching process. These filaments can break off the edges 214 and block the flow of ink to the ink firing chambers 220.

Figure 11:
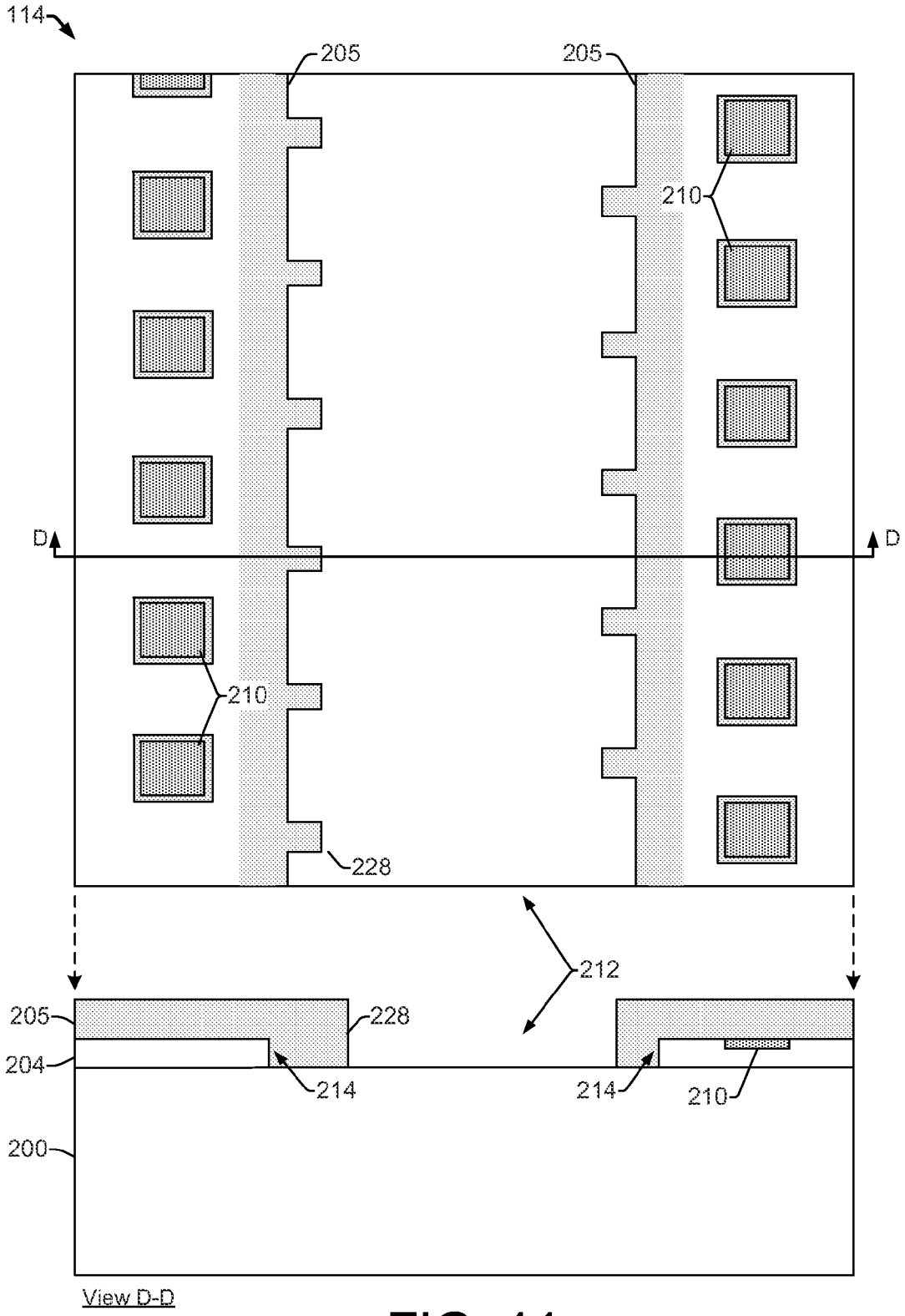

FIG. 11 shows a plan view and cross sectional view (across line D-D) of a portion of an example fluid ejection device 114 (i.e., printhead 114), according to an embodiment of the disclosure. In a next processing step, as shown in FIG. 11, a primer layer 205 is formed over the thin-film layer 204. The primer layer 205 can be a photo-imageable epoxy such as SU-8, formed by spin-coating or lamination, for example. The primer layer 205 can be defined to form a particle tolerant primer layer extension 228 as detailed herein above. In addition, the primer layer 205 is formed over the edges of the thin-film layer 204 to coat the edges 214. The primer layer 205 coating formed over the edges 214 of the thin-film layer 204 holds onto any metal filaments (e.g., Ta filaments) that are left by the etching process, and prevents the filaments from breaking off the edges 214 and blocking the flow of ink to the ink firing chambers 220.

Figure 12:
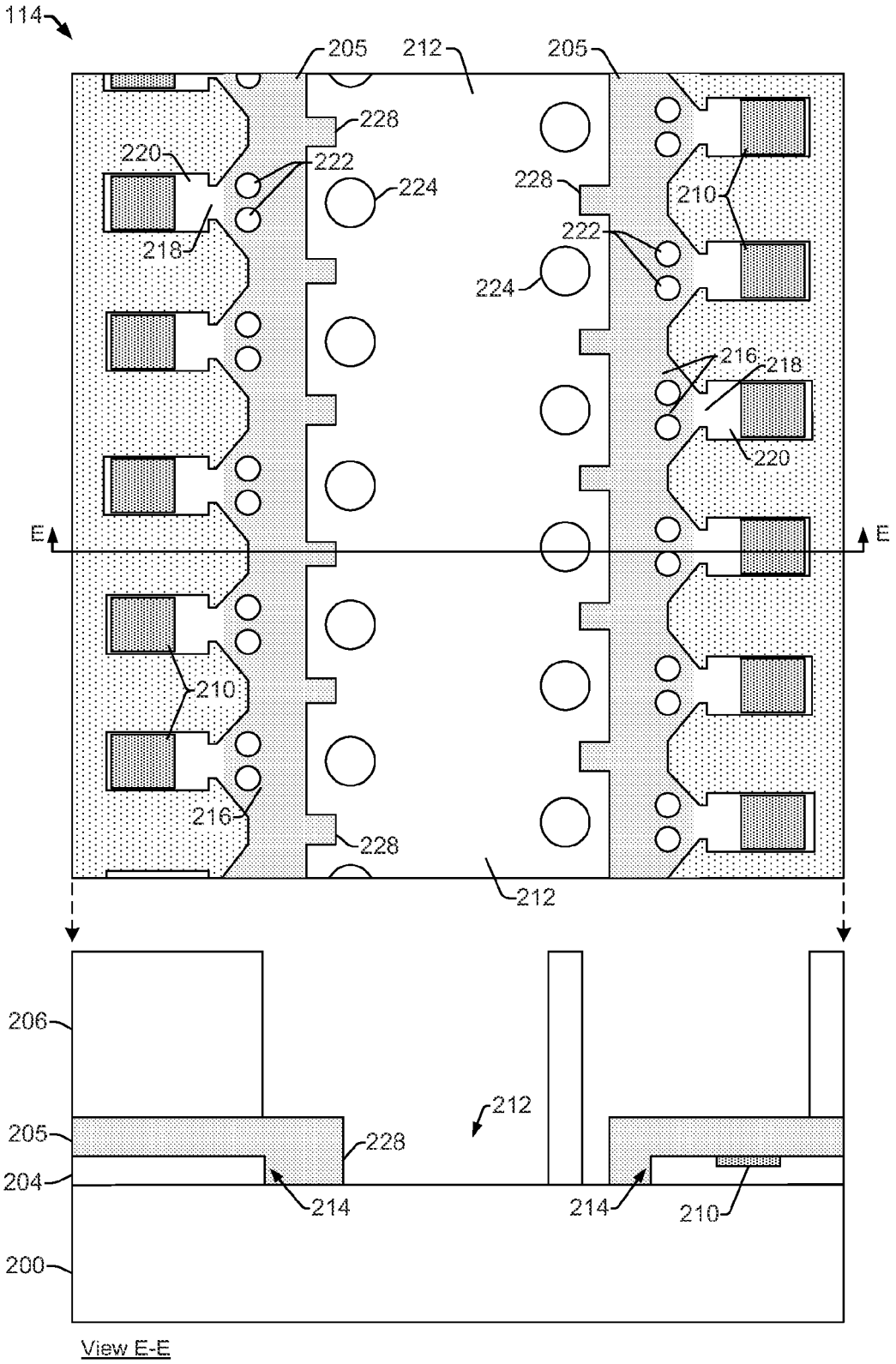

FIG. 12 shows a plan view and cross sectional view (across line E-E) of a portion of an example fluid ejection device 114 (i.e., printhead 114), according to an embodiment of the disclosure. In a next processing step, as shown in FIG. 12, a chamber layer 206 is formed over the primer layer 205. The chamber layer 206 can be a photo-imageable epoxy such as SU-8, formed by spin-coating or lamination, for example. The chamber layer 206 can be defined to include a number of fluidic features such as fluid/ink firing chambers 220, and channel inlets 216 and fluidic channels 218 that lead to the chambers 220. The fluidic firing chambers 220 are formed around and over corresponding thermal resistors 210 (ejection elements).

Figure 13:
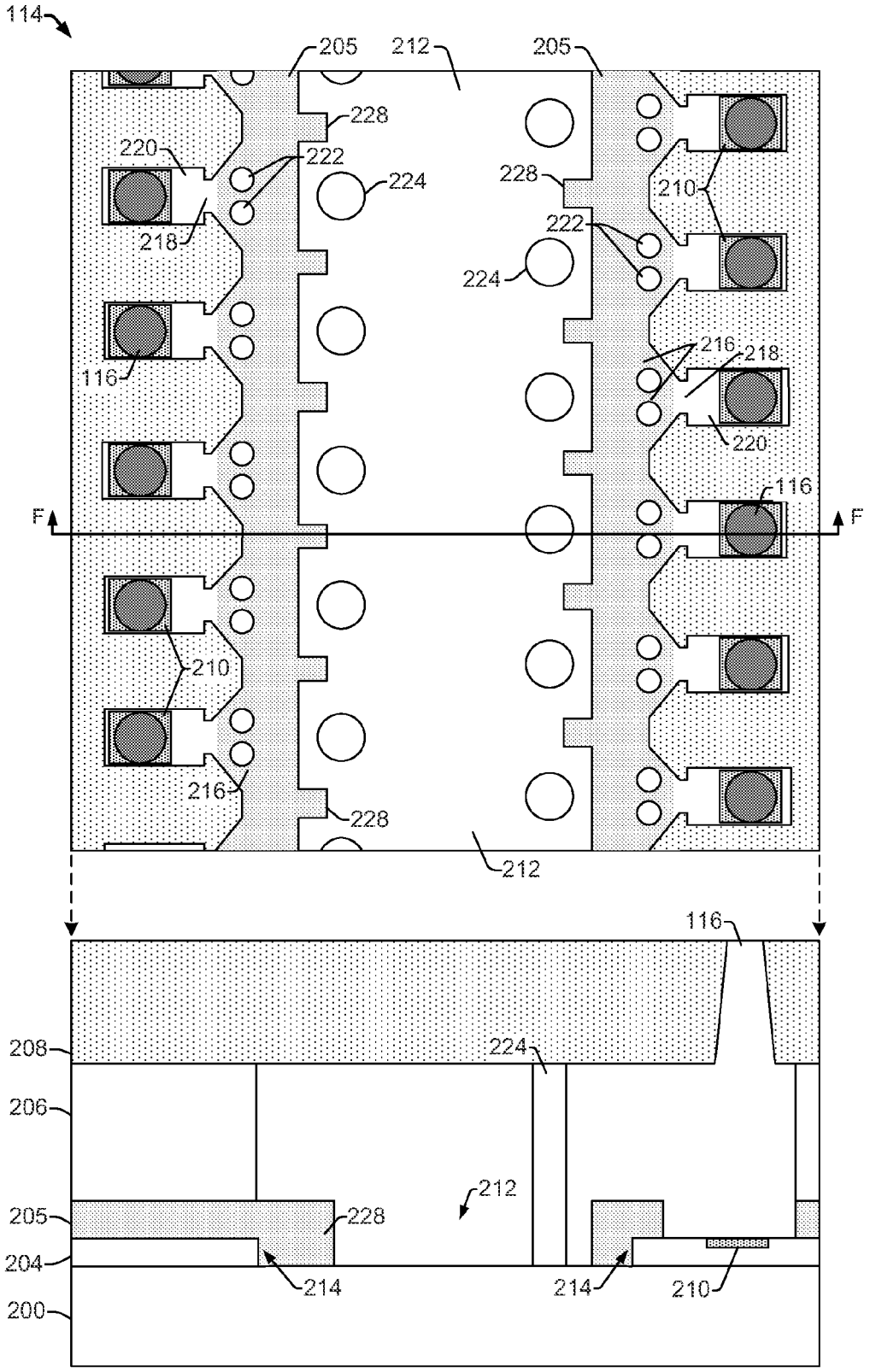

FIG. 13 shows a plan view and cross sectional view (across line F-F) of a portion of an example fluid ejection device 114 (i.e., printhead 114), according to an embodiment of the disclosure. In a next processing step, as shown in FIG. 13, a nozzle layer 208 is formed over the chamber layer 206. The nozzle layer 208 can be a photo-imageable epoxy such as SU-8, formed by spin-coating or lamination, for example. The nozzle layer 208 can be defined to include a number of fluidic features such as nozzles 116. Each nozzle 116 corresponds with a respective chamber 220 and thermal resistor 210.

While particle tolerant architectures have been described herein as being formed by a primer layer extension 228, in other implementations, similarly designed particle tolerant architectures (e.g., as shown in FIGS. 2, 6, 7, 8, 9) can be formed by the thin-film layer 204. That is, the thin-film layer 204 can be patterned to form particle tolerant architectures in designs such as those shown in FIGS. 2, 6, 7, 8, and 9. In such implementations, where the thin-film layer 204 forms such particle tolerant architectures, the primer layer extension 228 maintains the purpose of extending over the edges 214 of the thin-film layer 204 to coat the edges 214 and prevent metal filaments (e.g., Ta filaments) from breaking off the edges 214 and blocking the flow of ink to the ink firing chambers 220.

What is claimed is:

1. A fluid ejection device comprising:

a thin-film layer formed over a substrate;

a primer layer formed over the thin-film layer;

a chamber layer formed over the primer layer that defines a fluidic channel leading to a firing chamber;

a slot extending though the substrate and into the chamber layer through an ink feed hole in the thin-film layer;

a particle tolerant extension of the primer layer that protrudes into the slot; and at least one shelf pillar defined in the chamber layer and located at an inlet to the fluidic channel.

2. A fluid ejection device as in claim 1, further comprising a coating formed by the primer layer to coat edges of the thin-film layer.

3. A fluid ejection device as in claim 1, further comprising a nozzle layer over the chamber layer that forms a top over the firing chamber, the fluidic channel, and the slot.

4. A fluid ejection device as in claim 3, further comprising hanging pillars defined in the chamber layer and adhered to the top such that they extend into the slot.

5. A fluid ejection device as in claim 4, wherein the particle tolerant extension comprises a plurality of primer layer protrusions partially interleaved between the hanging pillars.

6. A fluid ejection device as in claim 5, wherein the primer layer protrusions comprise primer layer protrusions of varying lengths.

7. A fluid ejection device as in claim 1, wherein the particle tolerant extension spans across an entire width of the slot.

8. A fluid ejection device as in claim 7, wherein the particle tolerant extension comprises multiple ink feed holes.

9. A fluid ejection device as in claim 1, wherein the fluidic channel comprises a recirculation channel that leads to the firing chamber from first and second channel inlets in fluid communication with the slot.

10. A fluid ejection device as in claim 1, wherein the particle tolerant extension is an extension of the thin-film layer that protrudes into the slot, the fluid ejection device further comprising a coating formed by the primer layer to coat edges of the thin-film layer.

11. A fluid ejection device as in claim 1, wherein the particle tolerant extension is formed from a photo-definable epoxy.

12. A fluid ejection device comprising:

a thin-film layer formed over a substrate;

a chamber layer formed over the thin-film layer;

an ink feed hole formed through the thin-film layer that fluidically couples a slot between the substrate and chamber layer; and a particle tolerant SU-8 primer layer over the thin-film layer that extends into the slot and over edges of the ink feed hole to coat the edges of the ink feed hole.

13. A fluid ejection device as in claim 12, further comprising:

a nozzle layer formed over the chamber layer;

pillars formed in the chamber layer that hang from the nozzle layer;

wherein the extended SU-8 primer layer forms finger-like protrusions interleaved with the pillars.

14. A fluid ejection device as in claim 12, wherein the extended SU-8 primer layer forms a particle tolerant architecture that extends across an entire width of the slot.

15. A fluid ejection device comprising:

a thin-film layer formed over a substrate;

a primer layer formed over the thin-film layer;

a chamber layer formed over the primer layer that defines a fluidic channel leading to a firing chamber;

a slot extending though the substrate and into the chamber layer through an ink feed hole in the thin-film layer; and at least one hanging pillar defined in the chamber layer and adhered to the top such that they extend into the slot.

16. The fluid ejection device of claim 15, further comprising a nozzle layer over the chamber layer that forms a top over the firing chamber, the fluidic channel, and the slot.

17. The fluid ejection device of claim 15 further comprising a particle tolerant extension of the primer layer that protrudes into the slot.

18. The fluid ejection device of claim 17, wherein the particle tolerant extension comprises a plurality of primer layer protrusions.

19. The fluid ejection device of claim 15 wherein the primer layer is an SU-8 primer layer.

* * * * *